US008298620B2

(12) United States Patent
Ilias et al.

(10) Patent No.: US 8,298,620 B2
(45) Date of Patent: Oct. 30, 2012

(54) METHODS OF PREPARING THIN FILMS BY ELECTROLESS PLATING

(75) Inventors: Shamsuddin Ilias, Greensboro, NC (US); Mohammad A. Islam, Houston, TX (US)

(73) Assignee: North Carolina Agricultural and Technical State University, Greensboro, NC (US)

( * ) Notice: Subject to any disclaimer, the term of this patent is extended or adjusted under 35 U.S.C. 154(b) by 404 days.

(21) Appl. No.: 12/464,990

(22) Filed: May 13, 2009

(65) Prior Publication Data

US 2010/0068391 A1 Mar. 18, 2010

Related U.S. Application Data

(60) Provisional application No. 61/052,798, filed on May 13, 2008.

(51) Int. Cl.
*B05D 1/18* (2006.01)
*B05D 3/10* (2006.01)

(52) U.S. Cl. ..... 427/437; 427/304; 427/443.1

(58) Field of Classification Search ..... 427/304, 427/305, 306, 435, 436, 437, 438, 443.1
See application file for complete search history.

(56) References Cited

U.S. PATENT DOCUMENTS 4,873,136 A * 10/1989 Foust et al. ..... 428/209
5,348,574 A 9/1994 Tokas et al.
2003/0138490 A1* 7/2003 Hu et al. ..... 424/486

OTHER PUBLICATIONS

Chen et al, Effects of Surfactants in an Electroless Nickel-Plating Bath on the Properties of Ni-P Alloy Deposits, 2002, Ind. Eng. Chem. Res., vol. 41, p. 2668-2678.*
Yin et al, Role of a Pb2+ Stabilizer in the Electroless Nickel Platin gSystem: A Theoretical Exploration, 2004, J. Phys. Chem. B, vol. 108, p. 10919-10929.*
Ilias et al. "Application of Electroless Deposited Thin-Film Palladium Composite Membrane in Hydrogen Separation", *Separation Science and Tech.* 32(1-4)487-504 (1997).
Ilias et al. "Preparation and Characterization of Composite Membrane for High Temperature Gas Separation", *Final Report to U.S. Dept. of Eng. Grant* No. DE-FG22-93MT93008 i-45 (1998).
Ilias et al. "Enhancement of Equilibriumshift in Dehydrogenation Reactions Using a Novel Membrane Reactor", *Final Report to U.S. Dept. of Eng. Grant* No. DE-FG22-96PC96222 (2001).
Ilias et al. "Reforming of Liquid Hydrocarbons in a Novel Hydrogen-Selective Membrane-Based Fuel Processor", *Final Report to U.S. Dept. of Eng. Grant* No. DE-FG26-01NT41361 i-71 (2006).
Kikuchi "Palladium/ceramic membranes for selective hydrogen permeation and their application to membrane reactor", *Catalysis Today* 25:333-337 (1995).
Ma et al. "Sulfur-Tolerant Palladium Copper Alloy Membranes for Hydrogen Separation with High Pressure $CO_2$ for Sequestration", *UCR Contractors Review Conference* (2006).

(Continued)

*Primary Examiner* — Dah-Wei Yuan
*Assistant Examiner* — Nga Leung V Law
(74) *Attorney, Agent, or Firm* — Myers Bigel Sibley & Sajovec, P.A.

(57) ABSTRACT

The present invention provides methods of controlling properties of a thin film applied to a substrate whereby the properties of the thin film may be controlled by the surface morphology of the substrate. Methods of increasing a deposition rate of an electroless plating process applied to a substrate, controlling the grain size distribution and/or grain size of a thin film applied to a substrate and maintaining a uniform overpotential of an electroless plating process on a substrate are also provided.

14 Claims, 5 Drawing Sheets

OTHER PUBLICATIONS

Uemiya et al. "Separation of hydrogen through palladium thin film supported on a porous glass tube", *J. Membrane Sci.* 56:303-313 (1991).
Yeung et al. "Novel preparation of Pd/Vycor composite membranes", *Catalysis Today* 25:231-236 (1995).
Jayaraman, V., (1995) Fabrication of ultrathin membranes on ceramic supports by sputter deposition. J. Memb. Sci., 99: 89-100.
Jayaraman, V., and Lin, Y.S. (1995) Synthesis and hydrogen permeation properties of ultrathin palladium-silver alloy membranes. J. Memb. Sci., 104: 251-262.
Bryden, K.J., and Ying, J.Y. (1995) Nanostructured palladium membrane synthesis by magnetron sputtering. Materials Science and Engineering, A204: 140-145.
Xomeritakis, G., and Lin, Y.S. (1998) CVD synthesis and gas permeation properties of thin palladium/alumina membranes. AIChE J., 44 (1): 174-183.
Nam, S.E., and Lee, K.H. (2005) Preparation and characterization of palladium alloy composite membranes with a diffusion barrier for hydrogen separation. Ind. Eng. Chem. Res., 44: 100-105.
Ma, Y.H., et al (2003) Thin composite palladium and palladium/alloy membranes for hydrogen separation. Ann. N.Y. Acad. Sci., 984: 346-360.
Lu, G.Q., et al. (2007) Inorganic membranes for hydrogen production and purification: A critical review and perspective. J. Colloid and Interface Science, 314: 589-603.
Souleimanova, R.S., et al (2000) Effects of osmosis on microstructure of Pd-composite membranes synthesized by electroless plating technique. J. Memb. Sci., 166: 249-257.
Roa, F., et al (2003) Preparation and characterization of Pd-Cu composite membranes for hydrogen separation. Chemical Engineering Journal, 93: 11-22.
Goto, S., (2000) The effect of direction of hydrogen permeation on the rate through a composite palladium membrane. J. Memb. Sci., 175: 19-24.
Hou, K., and Hughes, R. (2002) The effect of external mass transfer, competitive adsorption and coking on hydrogen permeation through thin Pd/Ag membranes. J. Memb. Sci., 206: 119-130.
Rothenberger, K.S., et al. (2004) High pressure hydrogen permeance of porous stainless steel coated with a thin palladium film via electroless plating. J. Memb. Sci., 244: 55-68.
Lee, D.W., et al (2003) Study on the variation of morphology and separation behavior of the stainless steel supported membranes at high temperature. J. Memb. Sci., 220: 137-153.
Barton, J.L., and Bockris, J. O'M. (1962) The electrolytic growth of dendrites from ionic solutions. Proceedings of the Royal Society of London. Series A, Mathematical and Physical Sciences, 268 (1335): 485-505.
Ayturk, M.E., et al. (2008) Isothermal nucleation and growth kinetics of Pd/Ag alloy phase via in situ time-resolved high-temperature X-ray diffration (HTXRD) analysis. J. Memb. Sci., 316: 97-111.
Saji, T., et al., (1994) "Electroless Plating of Organic Thin Films by Reduction of Nonionic Surfactants Containing an Azobenzene Group" J. Am. Chem. Soc. 1994,116, 6053-6054.
Chen, B-H., et al., (2002) "Effects of Surfactants in an Electroless Nickel-Plating Bath on the Properties of Ni-P Alloy Deposits" Ind. Eng. Chem. Res. 2002, 41, 2668-2678.
Islam et al. "Effect of surfactants in fabrication of palladium thin-film composite membrane by electroless plating method", NAMS (2007) 10 pages.

* cited by examiner

METHODS OF PREPARING THIN FILMS BY ELECTROLESS PLATING

RELATED APPLICATION INFORMATION

This application claims priority to and the benefit of U.S. Patent Application Ser. No. 61/052,798, filed May 13, 2008, the disclosure of which is incorporated by reference herein in its entirety.

STATEMENT OF GOVERNMENT SUPPORT

Aspects of this research are supported by the US DOE-NETL: DE-FG26-05NT42492. The U.S. Government has certain rights to this invention.

FIELD OF THE INVENTION

The present invention generally relates to methods of preparing thin film on microporous substrates by electroless plating.

BACKGROUND OF THE INVENTION

Electroless plating, also known as chemical or auto-catalytic plating, is a non-galvanic type of plating method that involves several simultaneous reactions in an aqueous solution, which occur without the use of external electrical power. Generally, the reaction is accomplished when hydrogen is released by a reducing agent and oxidized thus producing a negative charge on the surface of the part.

It is well-known that it is challenging to control film integrity and mechanical and thermal stability of thin films prepared by palladium thin-film deposition by electroless plating on microporous substrates. In particular, when the films are subjected to thermal cycling and prolonged operation at an elevated temperature and pressure, it may be problematic to control these characteristics of electroless deposited Pd/Pd—Ag thin-film on stainless steel substrates (Ilias, S., et al. (1997); Ilias, S. (1998); Ilias, S. (2001) and Ilias, S. (2006)).

In electroless plating deposition, the activation step may be crucial in fabricating palladium films. In general, pure and uniformly sparse palladium nuclei are required for catalytic deposition of palladium on porous surfaces. Usually, the sensitization/activation process helps to form a thin layer of atomic seed on the surface of the substrate to stimulate auto catalyzation prior to plating (Jost, W. (1969); Yeung, K. (1995); and Kikuchi, E. (1995)). In most conventional processes of fabrication of palladium membranes, the activation involves simultaneous oxidation-reduction reactions between palladium and oxidizing metal reagents, for example $SnCl_2/PdCl_2$. The simultaneous oxidation-reduction reaction introduces multifarious impurity of the palladium complex such as impregnated palladium hydroxide ($Pd(OH)_3$), hydrated palladium ($Pd\text{-}xH_2O$), palladium chloride or acetate ($PdCL_2$, $Pd(CH_3COO)_2$), and poorly soluble hydrated stannous chloride ($Sn(OH)_{1.5}CL_{0.5}$). In the conventional electroless plating process, the nucleation and growth of palladium seed may locate only on a portion of the surface, which forms peel layers of coarse palladium particles. The uneven nucleation and growth of palladium seed may inhibit layer-to-layer overgrowth of palladium films on the substrate. Moreover, the deposited films may form severe lattice mismatching after long-term permeation exposure. Additionally, thermal stress may be developed between the substrate and deposited films, which may result in mechanical and thermal instability of the Pd-composite membrane (Uemiya, S. (1991)).

In the last decade, researches have shown that the stress in the polycrystalline deposited Pd-film prepared by conventional techniques such as an electroless plating process can be minimized by alloying with others metals. Recently, it has been reported that an inter-metallic diffusion layer, for example, oxide layer, is used to fabricate Pd—Cu alloy membranes on stainless steel substrates and there is some success in thermal stability of the membranes. (See Ma, Y. H., and Pomerantz, N., 2006 UCR Contractors Review Conference, Pittsburgh, Abstract pp. 15-16, (2006)).

However, in view of limited methods of fabricating thin films prepared by electroless plating, there is a significant need for an improved method to prepare thin films by electroless plating.

SUMMARY OF THE INVENTION

The present invention provides methods of controlling properties of a thin film applied to a substrate, wherein the method comprises: (1) applying at least one surfactant to a substrate to modify the surface morphology of the substrate, and (2) subjecting the substrate to an electroless plating process to form a thin film, wherein the properties of the thin film are controlled by the surface morphology of the substrate.

One aspect of the invention provides methods of increasing deposition rates of an electroless plating process applied to a substrate, the method comprising: (1) applying one or more surfactants to a substrate; and (2) subjecting the substrate to an electroless plating process; wherein said surfactant is applied in such a manner that the deposition rate of the electroless plating process is increased.

Another aspect of the invention provides methods of controlling the grain size distribution and grain size of a thin film applied to a substrate, the method comprising: (1) applying one or more surfactants to a substrate; and (2) subjecting the substrate to an electroless plating process; wherein said surfactant is applied in such a manner that the grain size distribution and grain size of the electroless plating process is controlled.

One aspect of the present invention provides methods of maintaining a uniform overpotential of an electroless plating process on a substrate, the method comprising applying one or more surfactants to a substrate to remove gas from the surface of the substrate, wherein said gas is produced during the electroless plating process.

In some embodiments, the substrate is activated. In some embodiments, the surfactant is a cationic surfactant. In some embodiments, the surfactant is dodecyl trimethylammonium bromide (DTAB) or dodecyltrimethylammonium chloride (DTAC). In some embodiments, the surfactant is a nonionic surfactant.

In some embodiments, the concentration of the surfactant is in the range between the critical micelle concentration and four times the critical micelle concentration of the surfactant.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 2(*b*) illustrates the SEM image of palladium film surface morphology on a 0.2 μm stainless steel substrate in the presence of Triton X-100.

FIG. 2(*c*) illustrates the SEM image of palladium film surface morphology on a 0.2 μm stainless steel substrate in the presence of sodium dodecyl benzyl sulfonate (SDBS).

FIG. 2(*d*) illustrates the SEM image of palladium film surface morphology on a 0.2 μm stainless steel substrate in the presence of DTAB.

FIG. 3(*b*) is a diagram illustrating the aggregate grain size distribution at different concentrations of Triton X-100.

FIG. 3(*c*) is a diagram illustrating the aggregate grain size distribution at different concentrations of SDBS.

FIG. 3(*d*) is a diagram illustrating the aggregate grain size distribution at different concentrations of DTAB.

DETAILED DESCRIPTION

Figure 1:
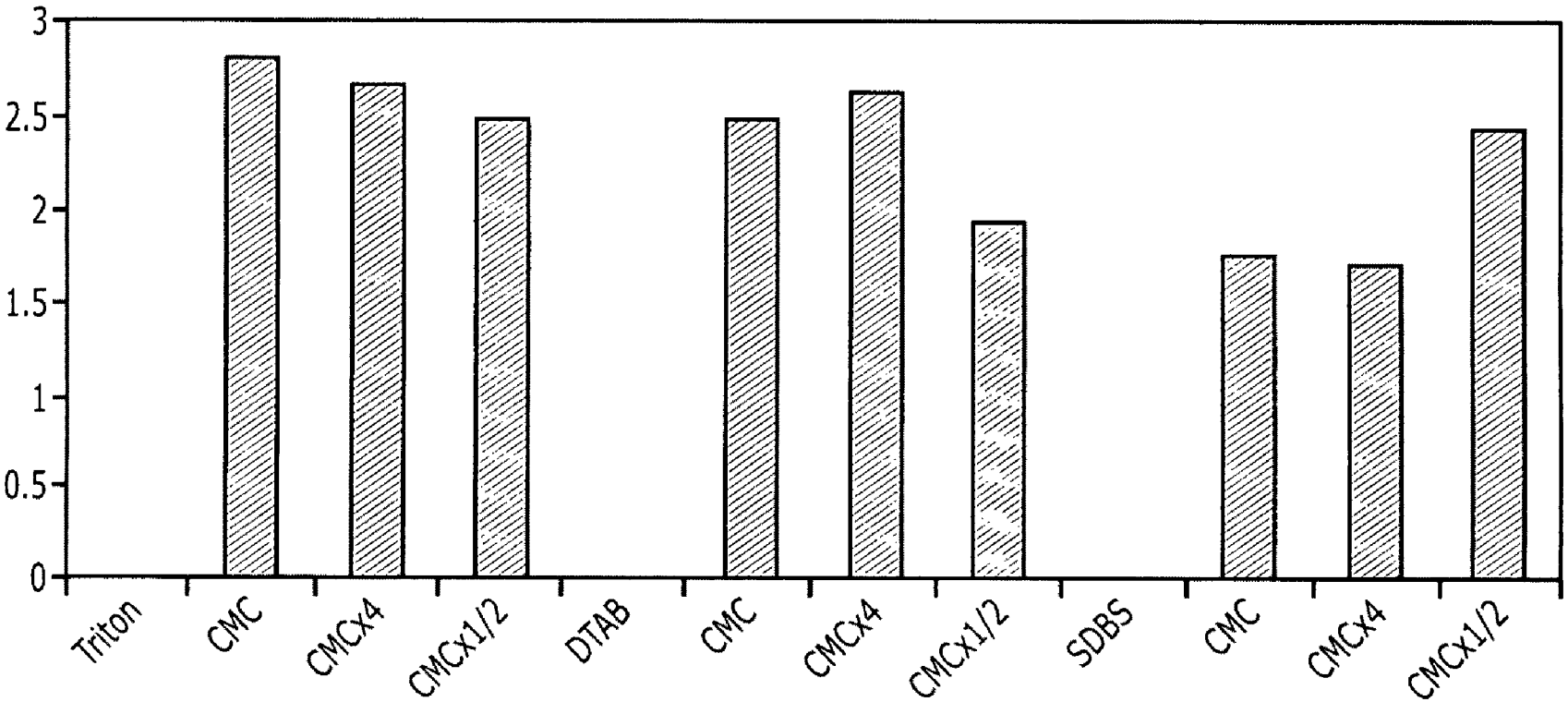
FIG. 1 graphically illustrates the effect of adding surfactants ($mg/cm^2$) on the rate of electroless plating of Pd at two hours.
Figure 2A:
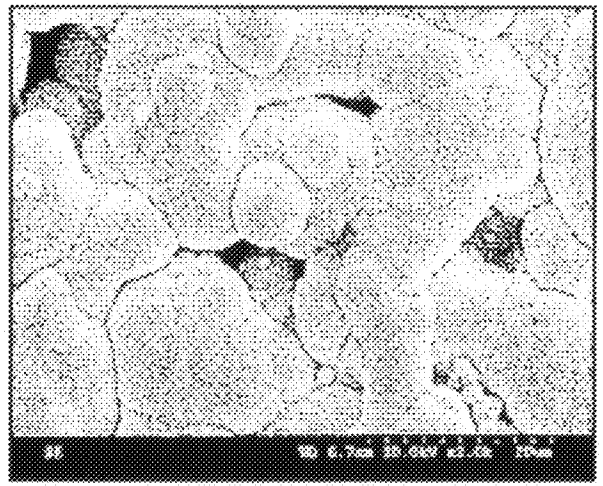
FIG. 2(*a*) illustrates the scanning electron microscope (SEM) image of palladium film surface morphology on a 0.2 μm stainless steel substrate in the presence of no surfactant.
Figure 2B:
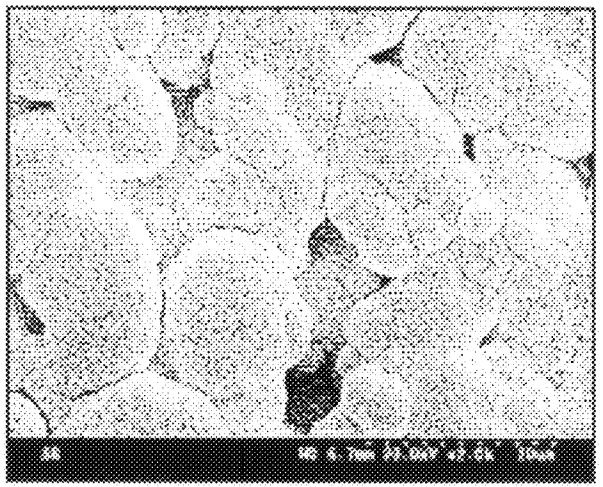
Figure 2C:
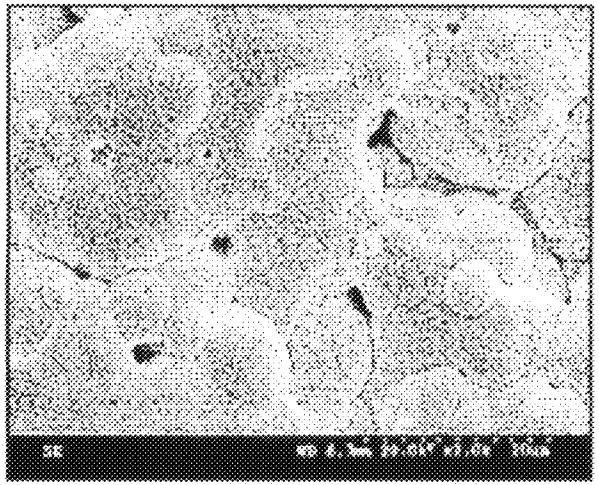
Figure 2D:
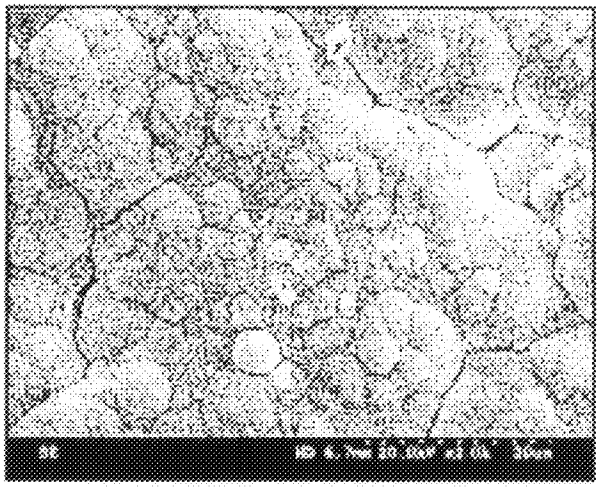
Figure 3B:
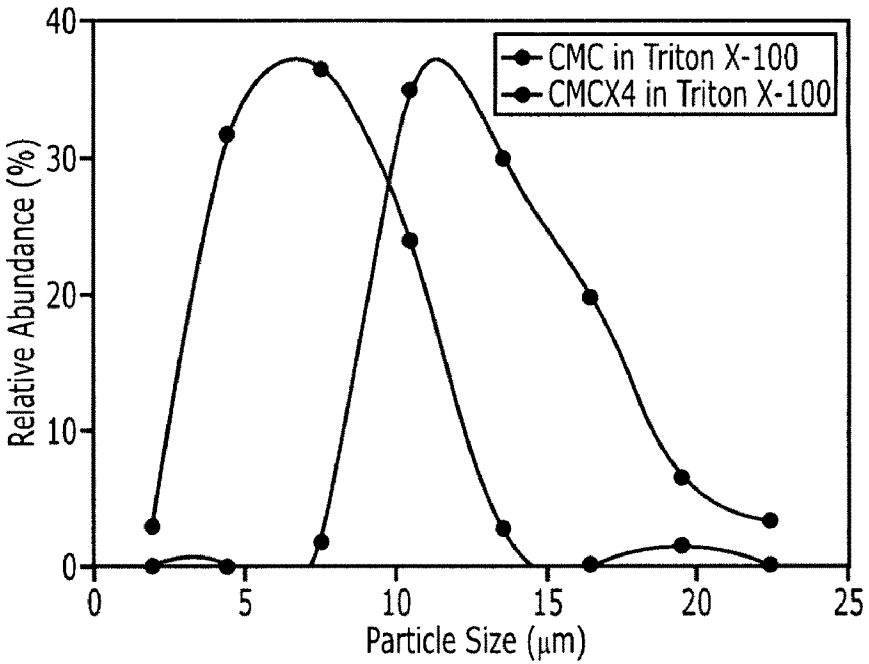
FIG. 3(*a*) is a diagram illustrating the aggregate grain size distribution in the presence of no surfactant.
Figure 3A:
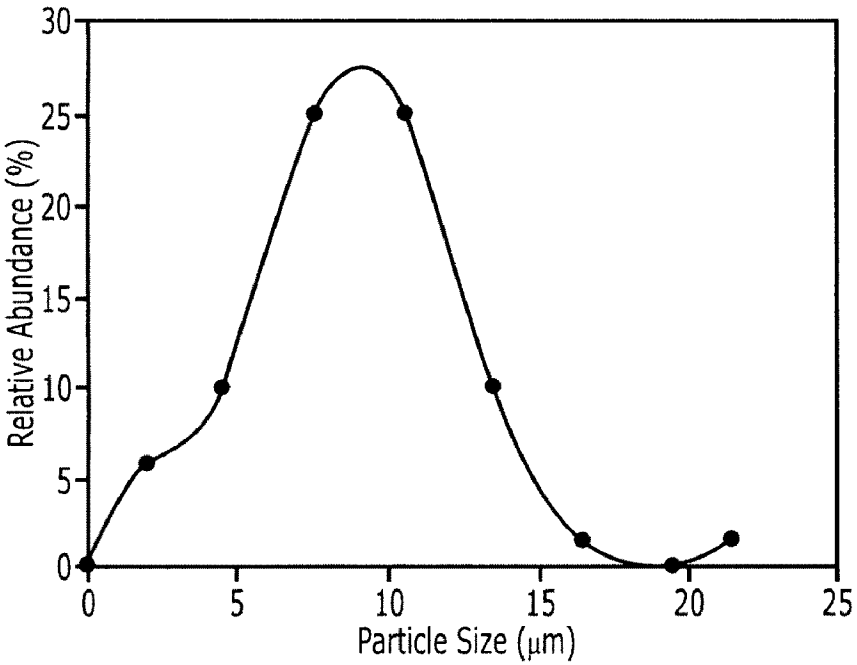
Figure 3C:
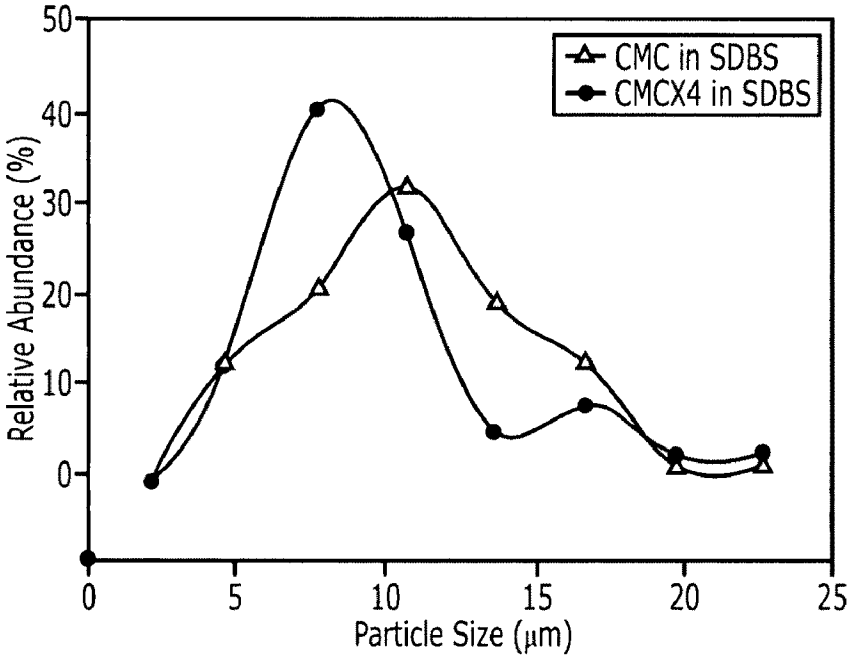
Figure 3D:
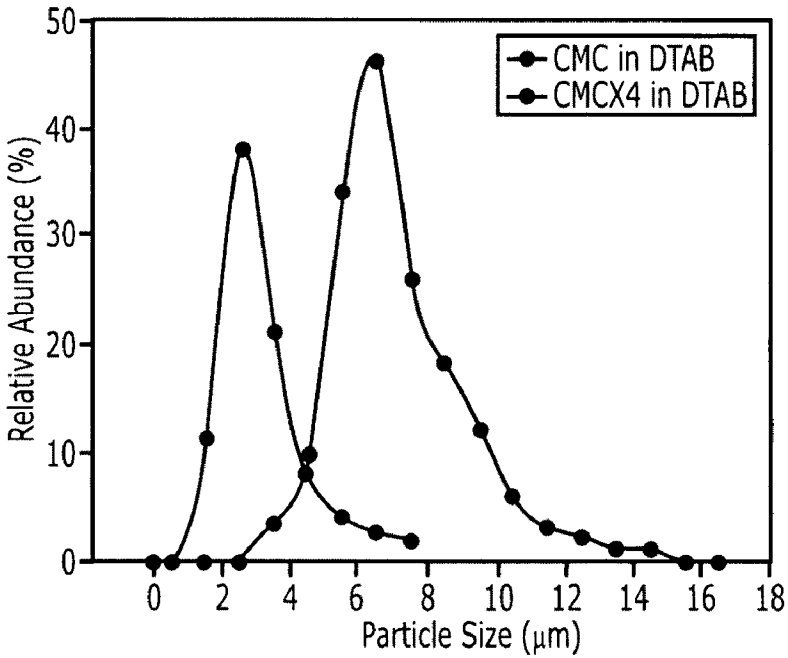

The foregoing and other aspects of the present invention will now be described in more detail with respect to the description and methodologies provided herein. It should be appreciated that the invention can be embodied in different forms and should not be construed as limited to the embodiments set forth herein. Rather, these embodiments are provided so that this disclosure will be thorough and complete, and will fully convey the scope of the invention to those skilled in the art.

All patents, patent applications and publications referred to herein are incorporated by reference in their entirety. In case of a conflict in terminology, the present specification is controlling.

The terminology used in the description of the invention herein is for the purpose of describing particular embodiments only and is not intended to be limiting of the invention. As used in the description of the embodiments of the invention and the appended claims, the singular forms "a", "an" and "the" are intended to include the plural forms as well, unless the context clearly indicates otherwise. Also, as used herein, "and/or" refers to and encompasses any and all possible combinations of one or more of the associated listed items. Furthermore, the term "about," as used herein when referring to a measurable value such as an amount of a compound, dose, time, temperature, and the like, is meant to encompass variations of 20%, 10%, 5%, 1%, 0.5%, or even 0.1% of the specified amount. Unless otherwise defined, all terms, including technical and scientific terms used in the description, have the same meaning as commonly understood by one of ordinary skill in the art to which this invention belongs.

The conventional electroless plating process is a heterogeneous process taking place at a solid-liquid interphase. In a conventional electroless plating process, the oxidation-reduction reaction between Pd-complex and a reducing reagent, for example, hydrazine, form a metallic deposition of $Pd^0$ on a solid surface, and thus, an efficient electron transfer between the phases may be imperative in dense film layer deposition. The surface morphology of the substrate controls the size of Pd grains and the degree of agglomeration. The oxidation-reduction reaction between the Pd-complex and hydrazine usually provides ammonia and nitrogen gas bubbles, which might hinder uniform Pd-film deposition when the bubbles are adhered to the surface of the substrate and in the pores. It is believed that the added surfactants can interact with the surface of the substrate and remove the gas from the liquid-solid interface. Therefore, the addition of surfactants may help maintain a uniform overpotential on the surface of the substrate and/or prevent dendrite formation.

The present invention provides methods of controlling properties of a thin film applied to a substrate, wherein the method comprises: (1) applying at least one surfactant to a substrate to modify the surface morphology of the substrate, and (2) subjecting the substrate to an electroless plating process to faun a thin film, wherein the properties of the thin film are controlled by the surface morphology of the substrate.

Another aspect of the present invention provides methods of increasing a deposition rate of an electroless plating process applied to a substrate, the method comprising: (1) applying one or more surfactants to a substrate; and (2) subjecting the substrate to an electroless plating process; wherein said surfactant is applied in such a manner that the deposition rate of the electroless plating process is increased.

Another aspect of the present invention provides methods of controlling the grain size distribution and grain size of a thin film applied to a substrate, the method comprising: (1) applying one or more surfactants to a substrate; (2) subjecting the substrate to an electroless plating process; wherein said surfactant is applied in such a manner that the grain size distribution and grain size of the electroless plating process is controlled.

One aspect of the present invention provides methods of maintaining a uniform overpotential of an electroless plating process on a substrate, the method comprising applying one or more surfactants to a substrate to remove gas from the surface of the substrate, wherein said gas is produced during the electroless plating process.

In some embodiments, the substrate is an activated substrate. As used herein, "activated substrate" means that an activation step is applied to the substrate for electroless plating. The activation step helps the deposited metal nuclei to seed uniformly throughout the surface of substrate, which may increase adhesion and/or agglomeration of the deposited layer. The activation step can be any activation process known to one of ordinary skill in the art such as pulsed laser deposition (PLD), or activation by $SnCl_2/PdCl_2$.

It is believed that the grain agglomeration rate of the plating process may depend on the concentration of surfactant. Generally, when the concentration of the surfactant increases, the agglomeration rate increases as well. However, the excess surfactant may cause segregation of micelles and affect the Pd-film morphology. In some embodiments, the concentration of the surfactant is at least at the critical micelle concentration of the surfactant. In another embodiment, the concentration of the surfactant is in a range between the critical micelle concentration (CMC) and four times the critical micelle concentration of the surfactant. In some embodiments, the concentration of the surfactant is about four times the critical micelle concentration.

It is further believed that the addition of cationic surfactants may lead to a uniform overpotential throughout the solid-liquid interface of the electroless plating, and therefore reduce the activation barrier and/or improve agglomeration. In addition, although non-ionic surfactants may not interact with the interface, the micelles of the surfactants may remain un-collapsed on the undersurface and thus, may help remove side products such as gas.

In some embodiments, the surfactant is a cationic or a non-ionic surfactant. In some embodiments, the surfactant is dodecyl trimethylammonium bromide (DTAB) or dodecyltrimethylammonium chloride (DTAC). In other embodiments, the surfactant is DTAB. In some embodiments, the concentration of DTAB is four times of its critical micelle concentration.

In some embodiments, the surfactant is a non-ionic surfactant. In some embodiments, the surfactant is Triton or Tergitol-NP-X. In some other embodiments, the surfactant is polyethylene glycol tert-octylphenyl ether (Triton X-100) or Tergitol-NP-9. In some embodiments, the surfactant is polyethylene glycol tert-octylphenyl ether. In some embodiments, the concentration of polyethylene glycol tert-octylphenyl ether is its critical micelle concentration.

The methods of the present invention may be applied to any microporous, metal or nonmetal substrate. In some embodiments, the methods of the present invention may be applied to stainless steel. The choice of the surfactants depends on several factors such as the substrates that electroless plating is applied to (hydrophobic or hydrophilic) and the desired property of the thin film as understood by one skilled in the art.

At sufficiently high concentrations of suitable surfactants, deposition may occur in a uniform overpotential throughout the surface. The grains fowled may be uniform and/or smaller in size to lead to a uniform agglomerate on the surface. The microstructure of Pd grains is uniform in size which may result in narrow size distribution.

The methods of the present invention may be applied to any thin film deposition. In particular embodiments, the deposition can be palladium or nickel thin film deposition.

The following examples are illustrative of the invention, and are not intended to be construed as limiting the invention.

EXAMPLES

General Procedures of Applying Surfactants

In the following examples, all surfactants chosen are soluble in water. The surfactants were applied during normal bath preparation. The concentrations of surfactants were maintained as a function of critical micelle concentration (CMC) to evaluate the effects of surfactants on electroless plating.

Non-ionic surfactant, polyethylene glycol tert-octylphenyl ether (Triton. X-100), a cationic surfactant, dodecyltrimethlammonium bromide (DTAB), and an anionic surfactant, sodium dodecylbenzenesulfonate (SDBS), were chosen to evaluate the effect of surfactants on electroless plating of palladium. The surfactants used in this example have similar chain length and comparable micelle size. The effects of surfactants were evaluated as a function of charge and critical micelle concentrations (CMC). Three different concentrations, CMC×½, CMC and CMC×4, were used in this example to evaluate the effect of the concentration on palladium deposition and surface morphology prior to, during and post micelle formation.

Example 1

FIG. 1 graphically illustrates the effect of adding surfactants on the rate of palladium electroless plating. Referring to FIG. 1, addition of surfactants, except SDBS, increases the palladium deposition rate by at least 20%. The highest deposition rate was achieved by adding the non-ionic surfactant, Trion X-100. The addition of cationic surfactant shows a relatively smaller increase in deposition rate. The palladium deposition rate was the lowest by adding the anionic surfactant, SDBS.

Example 2

The SEM images of Pd-film surface morphologies were also evaluated, which is illustrated in FIG. 2. The Pd-films prepared by adding Triton, STBS and DTAB surfactants at the concentration of CMC×4 were compared with the base case (i.e., no surfactant). Referring to FIG. 2, the best deposition in terms of surface morphology was found by adding DTAB.

Example 3

The Pd-grain size distributions were also evaluated, which is shown in FIG. 3. The Pd-grain size distributions of palladium thin films prepared in the process of adding DTAB, Triton X-100, or SDBS are compared with the base case (i.e., no surfactants). Referring to FIG. 3, when the concentration of the surfactant is greater than CMC×4, the grain size is much smaller compared to the concentration as CMC. When DTAB was added at the concentration greater than CMC×4, narrow size distribution and grain size within 1-3 μm were obtained (See FIG. 3*d*).

Example 4

Figure 4:
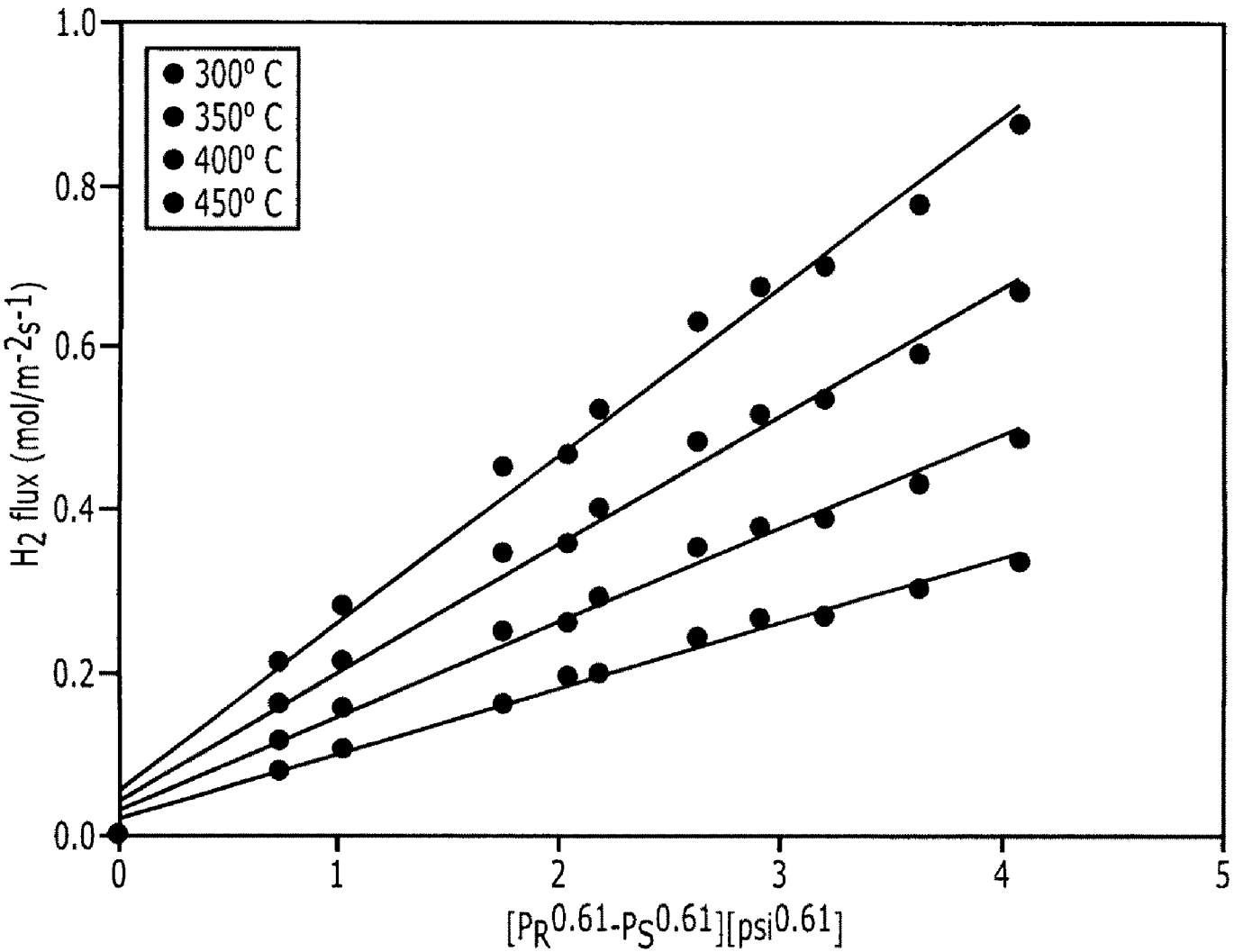
FIG. 4 illustrates hydrogen flux data for a Pd-composite membrane of a 7.68 pm film prepared in the presence of DTAB on a pulsed laser deposition (PLD)-activated microporous stainless steel substrate.

Several Pd-membranes on 0.2 μm stainless steel support activated by PLD or $SnCl_2/PdCl_2$ followed by DTAB induced electroless plating were prepared. The $H_2$-flux data at four different temperatures is illustrated in FIG. 4. From an Arhenius plot of $H_2$-permeability data, the membrane activation energy was found to be 16.877 kJ/mol, which is consistent with a membrane thinner than 10 μm.

REFERENCES

1. Ilias, S., et al., *Sep. Sci. & Tech.,* 32(1-4), 487 (1997).
2. Ilias, S., and King, F. G., Final Report to U.S. DOE-PETC, Grant No. DE-FG22-93MT93008, March, 1998.
3. Ilias, S., and King, F. G., Final Report to U.S. DOE-PETC, Grant No. DE-FG22-96PC96222, February, 2001.
4. Ilias, S., Final Report to U.S. DOE-NETL, Grant No. DE-FG26-01NT41361, March, 2006.
5. Jost, W., Diffusion, Academic Press, (1969).
6. Yeung, K., Sebastian, J., and Varma, A., *Catal. Today,* 25, 231 (1995).
7. Kikuchi, E., *Catalysis Today,* 25, 333 (1995).
8. Uemiya, S., et al., *J. Memb. Sci.,* 56, 303 (1991).
9. Ma, Y. H., and Pomerantz, N., 2006 UCR Contractors Review Conference, Pittsburgh, Abstract pp. 15-16, (2006).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A method of preparing a palladium thin film on an activated metal substrate by electroless plating, the method comprising:

applying at least one surfactant to said activated metal substrate, wherein said surfactant is dodecyl trimethylammonium bromide (DTAB), dodecyltrimethylammonium chloride (DTAC) or a polyethylene glycol tert-octylphenyl ether and wherein the concentration of said surfactant is at least at the critical micelle concentration of said surfactant.

2. The method of claim 1, wherein said activated metal substrate is microporous.

3. The method of claim 1, wherein the concentration of the surfactant is in a range between the critical micelle concentration and four times the critical micelle concentration of the surfactant.

4. The method of claim 1, wherein the surfactant is dodecyl trimethylammonium bromide (DTAB) or dodecyltrimethylammonium chloride (DTAC).

5. The method of claim 4, wherein the surfactant is DTAB.

6. The method of claim 5, wherein the concentration of DTAB is about four times its critical micelle concentration.

7. The method of claim 1, wherein the surfactant is a polyethylene glycol tert-octylphenyl ether.

8. The method of claim 7, wherein the concentration of the polyethylene glycol tert-octylphenyl ether is its critical micelle concentration.

9. The method of claim 6, wherein the aggregate grain size of the palladium thin film is in a range of about 1 to 3 μm.

10. The method of claim 1, wherein said activated metal substrate is stainless steel.

11. A method of preparing a palladium thin film on an activated metal substrate by electroless plating, the method comprising:

applying at least one surfactant to said activated metal substrate, wherein the concentration of said surfactant is at least the critical micelle concentration of said surfactant, wherein said surfactant is dodecyl trimethylammonium bromide (DTAB) or dodecyltrimethylammonium chloride (DTAC), and wherein said activated metal substrate is microporous.

12. The method of claim 11, wherein the concentration of said surfactant is in a range between the critical micelle concentration and four times the critical micelle concentration of said surfactant.

13. The method of claim 11, wherein the surfactant is DTAB.

14. The method of claim 13, wherein the aggregate grain size of the palladium thin film is in a range of about 1 to 3 μm.

* * * * *